United States Patent [19]

Eddy

[11] Patent Number: 5,014,381

[45] Date of Patent: May 14, 1991

[54] ROLLING PLATFORM ASSEMBLY

[76] Inventor: Jack E. Eddy, 5 Eddy La., Pelham, N.H. 03076

[21] Appl. No.: 408,254

[22] Filed: Sep. 18, 1989

[51] Int. Cl.[5] ..... E01D 9/00

[52] U.S. Cl. ..... 14/17; 49/56; 52/DIG. 12; 108/56.3; 182/12; 248/317; 248/343; 248/544

[58] Field of Search ..... 212/179, 176; 108/27, 108/42, 49, 55.1, 56.3, 149, 151, 152, 161; 14/1, 3, 17, 74, 18; 182/12, 38, 63, 145, 146, 230, 36, 130, 131, 141, 142, 143, 144, 148, 149, 150, 222, 223; 52/DIG. 12, 127.1, 127.2, 127.3, 127.7; 248/544, 317, 343, 916; 105/148, 155; 104/172.4, 168; 29/402.03, 402.04, 402.12, 402.14, 402.15, 426.1, 426.2, 426.3, 426.4, 431, 110, 130; 414/222, 331, 332, 349, 458, 459, 461, 922; 49/56

[56] References Cited

U.S. PATENT DOCUMENTS

| | | | |
|---|---|---|---|
| 2,203,113 | 6/1940 | Uecker et al. | 212/179 |
| 3,851,729 | 12/1974 | Gordon | 182/36 |
| 4,301,565 | 11/1981 | Weinbaum | 52/745 |
| 4,524,873 | 6/1985 | McGowan | 29/426.3 |
| 4,552,073 | 11/1985 | Smith | 105/148 |
| 4,633,975 | 1/1987 | Connor et al. | 182/143 |
| 4,674,586 | 6/1987 | Siemonsma | 105/148 |

FOREIGN PATENT DOCUMENTS

| | | | |
|---|---|---|---|
| 52439 | 5/1982 | European Pat. Off. | 182/150 |
| 1212575 | 3/1966 | Fed. Rep. of Germany | 14/1 |
| 1263744 | 10/1986 | U.S.S.R. | 14/1 |
| 1266919 | 10/1986 | U.S.S.R. | 14/17 |

*Primary Examiner*—Ramon S. Britts
*Assistant Examiner*—Roger J. Schoeppel
*Attorney, Agent, or Firm*—H. Jay Spiegel

[57] ABSTRACT

The present invention relates to a method of installing a platform assembly designed to be mounted below a bridge deck to prevent impeding traffic below the bridge deck during installation of the paltform assembly and during demolition of the bridge. The present invention also includes an apparatus assembly for practicing the method of the invention including a platform assembly and means necessary to install the platform assembly beneath the bridge deck.

2 Claims, 7 Drawing Sheets

ROLLING PLATFORM ASSEMBLY

BACKGROUND OF THE INVENTION

The present invention relates to a rolling platform assembly designed to be placed underneath a bridge deck during demolition thereof. Of course, structures used in connection with demolition of bridges are known. However, applicant is unaware of any prior art that includes all the features of the present invention including a sliding platform assembly that prevents the impediment of traffic beneath the bridge deck during demolition thereof. The following prior art is known to applicant.

U.S. Pat. Nos. 4,615,063 to Rolen and 4,103,861 to Buchler et al. are only generally related to the present invention.

U.S. Pat. No. 4,301,565 to Weinbaum discloses a method and system for moving and replacing bridge sections using a platform structure that is movable. Of course, the teachings of Weinbaum are different from the present invention wherein the inventive platform assembly is not used to replace a bridge section but rather prevents impediment of traffic during installation of the platform assembly and protects vehicles or pedestrians beneath a bridge during its demolition.

SUMMARY OF THE INVENTION

The present invention relates to a method and an apparatus designed to be placed beneath a bridge deck during demolition thereof to prevent the impediment of traffic below the bridge. "Demolition" is intended throughout the specification to mean the period of time needed to demolish and rebuild a bridge upper roadway until all danger of falling objects on a lower roadway due to the rebuilding process is over. The present invention includes the following interrelated aspects and features:

(a) In a first aspect, the present invention teaches a method of installing a platform assembly under a bridge deck.

(b) The platform assembly, the method of installation to be described hereinafter, includes a plurality of platforms attached to the flanged girders beneath a bridge deck that is to be demolished. The platforms are attached to the girders by clamping assemblies located at spaced intervals along the edges of the platforms.

(c) In the method of installing the platform assembly of the present invention, a first platform is hoisted beneath and between adjacent flanged girders that support the bridge deck to be demolished. Once the platform has been hoisted, roller assemblies are attached to the platform thereby enabling the platform assembly to roll along the flanges of the girders until coming to rest. At this point, the roller assemblies are sequentially replaced with clamping assemblies that secure the platform assembly to the flanges of the girders such that the platform assembly occupies a space beneath the bridge deck to be demolished and prevents impediment of traffic below. This sequence of hoisting, rolling and attaching the platform continues with additional platforms until all the space beneath the bridge is occupied by a secured platform assembly.

The hoisting step of the method of the present invention may be performed using a hoisting device designed to be installed beneath and between the girder webs to facilitate hoisting and rolling of the platforms.

Accordingly, it is a first object of the present invention to provide a new and improved rolling platform assembly to be used during bridge demolitions.

It is a further object of the present invention to provide a new and improved method of installing a rolling platform assembly to occupy all the space beneath a bridge deck thereby preventing impediment of any traffic beneath the bridge.

It is still a further object of the present invention to provide a new and improved rolling platform assembly that may be installed underneath a bridge without impeding traffic therebelow.

It is a yet further object of the present invention to provide a new and improved method and device for hoisting the platform assembly beneath a bridge that is scheduled to be demolished.

These and other objects, aspect and features of the present invention will be better understood from the following detailed description of the preferred embodiment when read in conjunction with the appended drawing figures.

SPECIFIC DESCRIPTION OF THE PREFERRED EMBODIMENT

Figure 1:
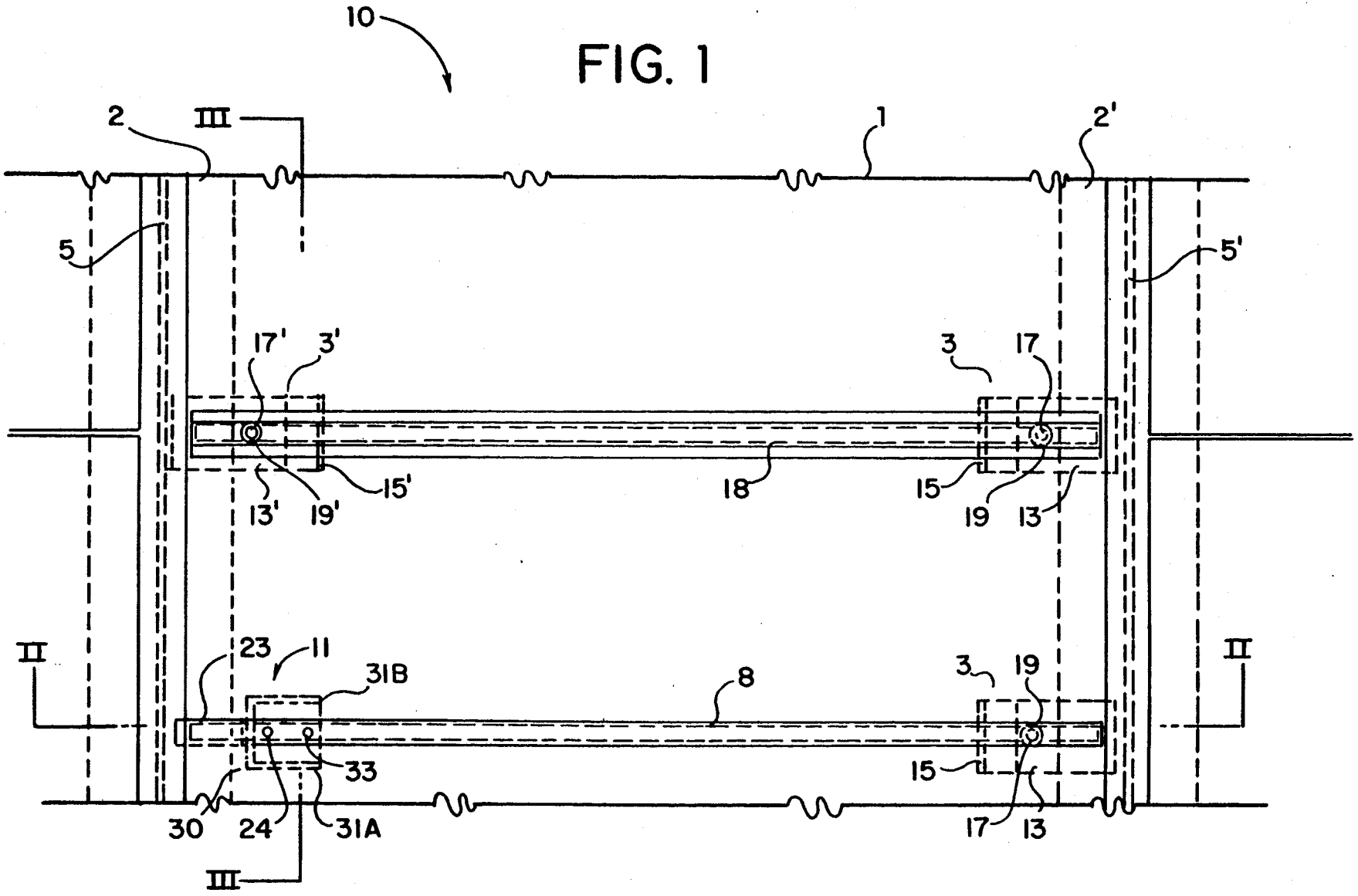
FIG. 1 shows a bottom view of a platform assembly of the present invention showing both the roller assembly and clamp assembly.

With reference firstly to FIG. 1, a bottom view of a cut away portion of the platform assembly of the present invention, generally designated by reference numeral 10, is shown and is seen to include platform 1 having support tubing 8, the platform 1 situated beneath adjacent girders 5 and 5' and girder flanges 2 and 2' of a bridge. As can be further seen from the drawing and to be more fully explained hereinafter, clamping assembly members 3 and 3' clamp the platform assembly 10 to girder flanges 2 and 2' at specified locations. Roller assembly 11 is attached to platform assembly 10 at a specified location to enable the platform to travel along girder flange 2.

Figure 2:
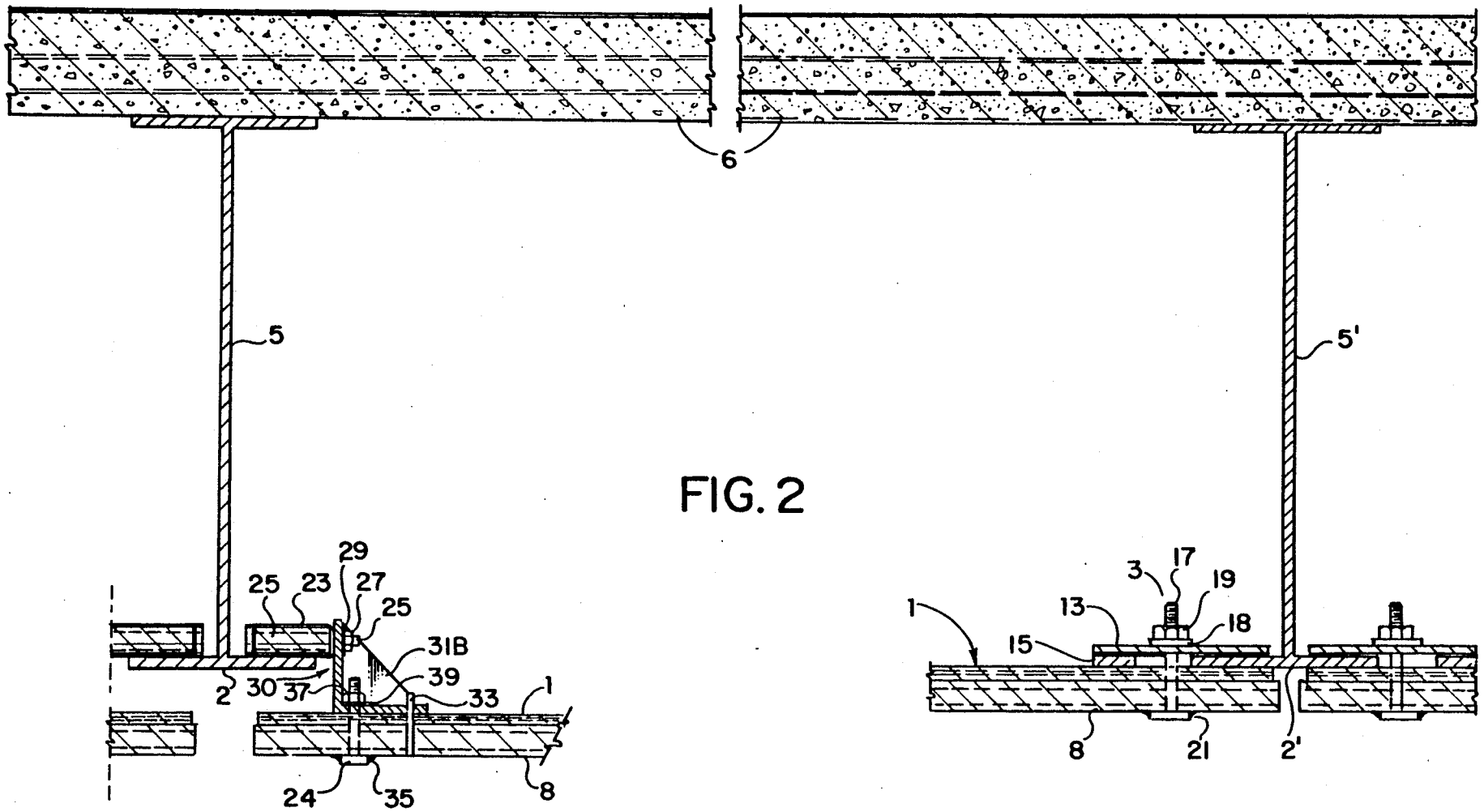
FIG. 2 shows a cross-sectional view along the line II—II of FIG. 1.

With reference to FIG. 2, a cross-sectional view along the line II—II of FIG. 1 more clearly illustrates the clamping and roller assemblies 3 and 11 (see also FIG. 1) of the present invention in relation to adjacent girders 5 and 5' and bridge deck 6. Clamping assembly 3 includes a plate 13, shim 15 situated between platform 1 and plate 13 and bolt 17 being welded to support tubing 8 at 21. The platform 1 is secured to girder flange 2' by tightening washer and nut, 18 and 19, respectively, on bolt 17 such that girder flange 2' and shim 15 are located between platform 1 and plate 13.

Figure 3:
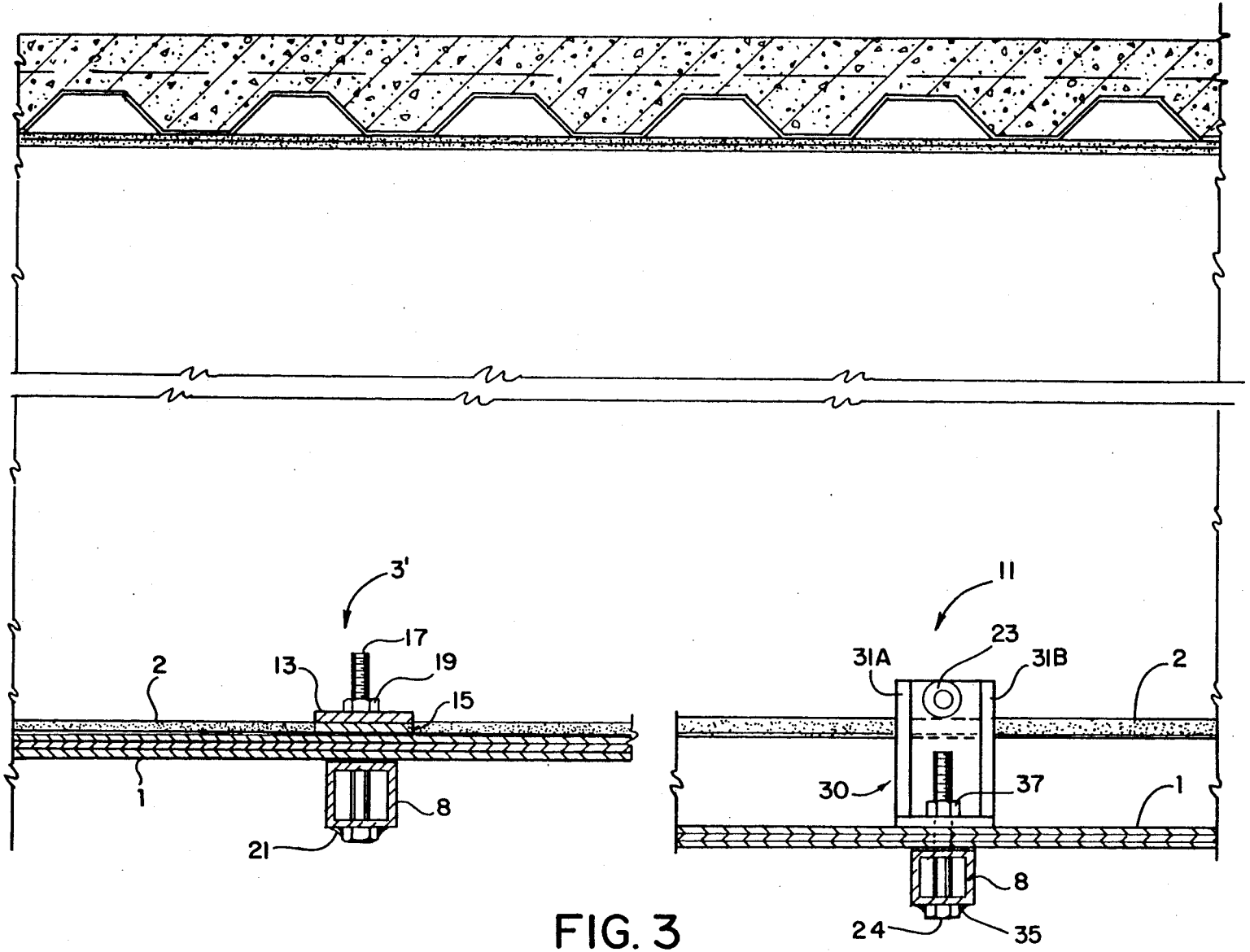
FIG. 3 shows a cross-sectional view along the line III—III of FIG. 1.

The roller assembly 11 is also shown in greater detail in FIGS. 2 and 3 and includes a gusset angle plate assembly 30 including two gusset angle plates 31A and 31B attached to platform 1 using bolt 24, nut and washer 37 and 39, respectively, and dowel pin 33. Bolt 24 is welded at 35 to support tubing 8 of the platform assembly. Also included in roller assembly 11 is roller 23 located on shoulder bolt 25 and attached to gusset plate assembly 30 by nut and washer, 27 and 29, respectively. Roller assembly 11 is designed to enable the platform assembly 10 to roll along girder flange 2 during installation of the platform assembly 10 beneath the bridge deck 6.

With reference to FIG. 3, a cross-sectional view along the line III—III of FIG. 1 depicts a side view of the clamping and roller assemblies 3' and 11 and more clearly shows the bolts, 21 and 24, respectively, of clamping and roller assemblies, 3' and 11, respectively as attached to support tubing 8.

Figure 4:
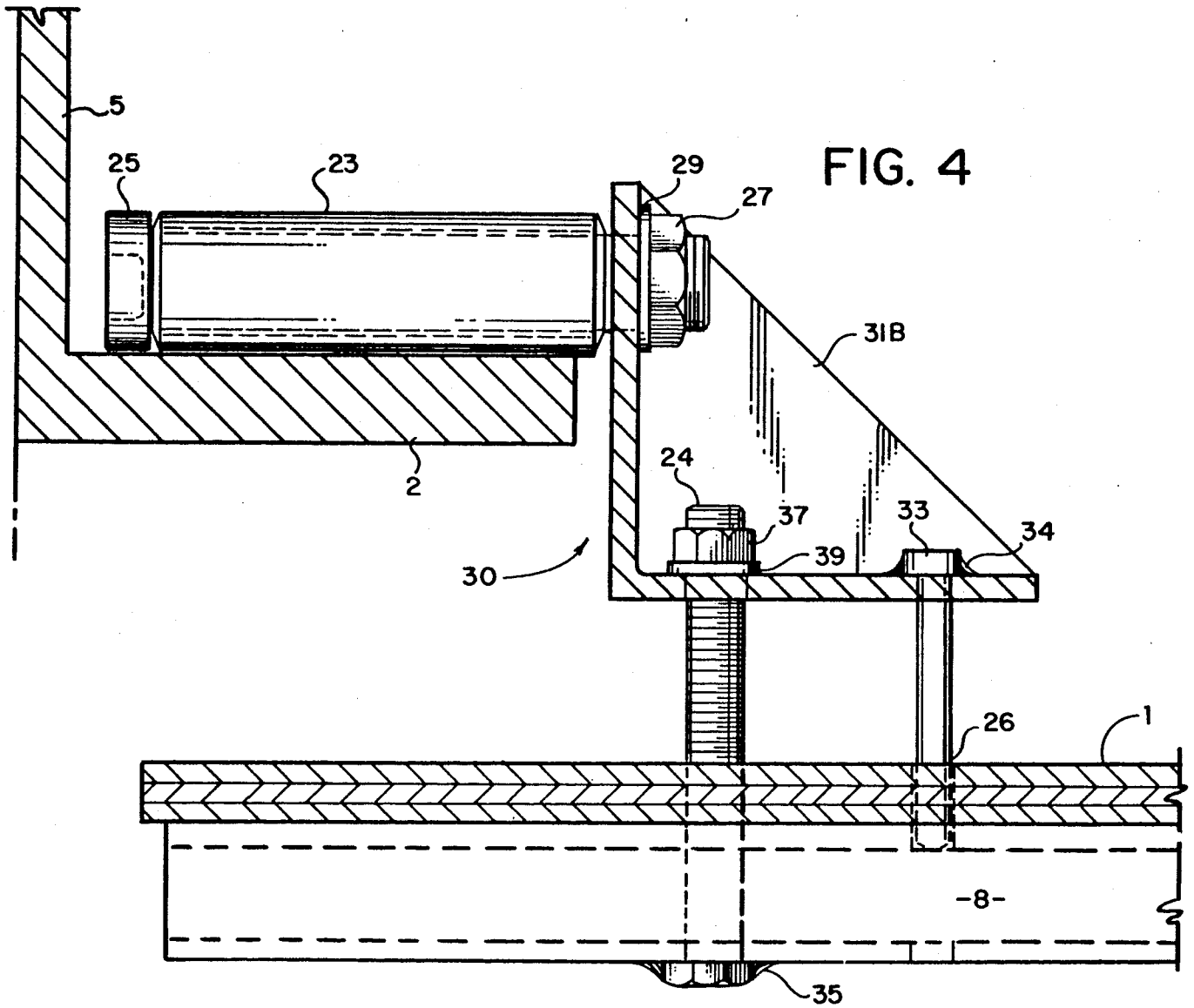
FIG. 4 shows a side view of the roller assembly of the present invention enlarged to show greater detail.

FIG. 4 shows a more detailed view of the roller assembly 11 of the present invention and is seen to include dowel pin 33 welded to gusset angle plate assembly 30 at 34 and inserted into platform assembly through opening 26 that extends through platform 1 and support tubing 8. Dowel pin 33 assists in maintaining the travel of roller assembly 11 parallel to girder 5 during movement of the platform assembly 10 along girder flange 2.

Figure 5:
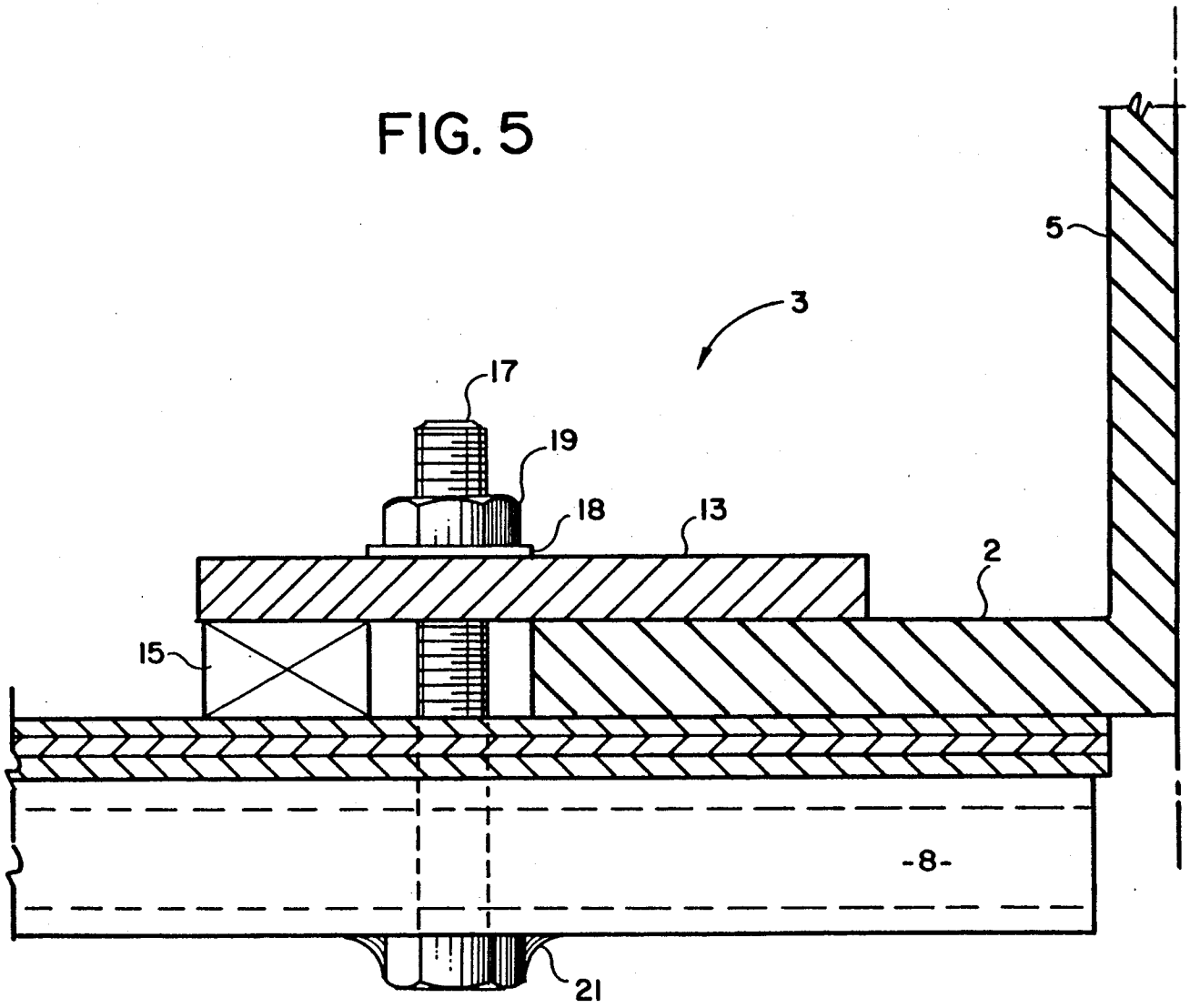
FIG. 5 shows a side view of the clamp assembly of the present invention enlarged to show greater detail.

FIG. 5 more clearly depicts clamping assembly 3 showing in greater detail weld 21 attaching bolt 17 to support tubing 8.

Figure 6:
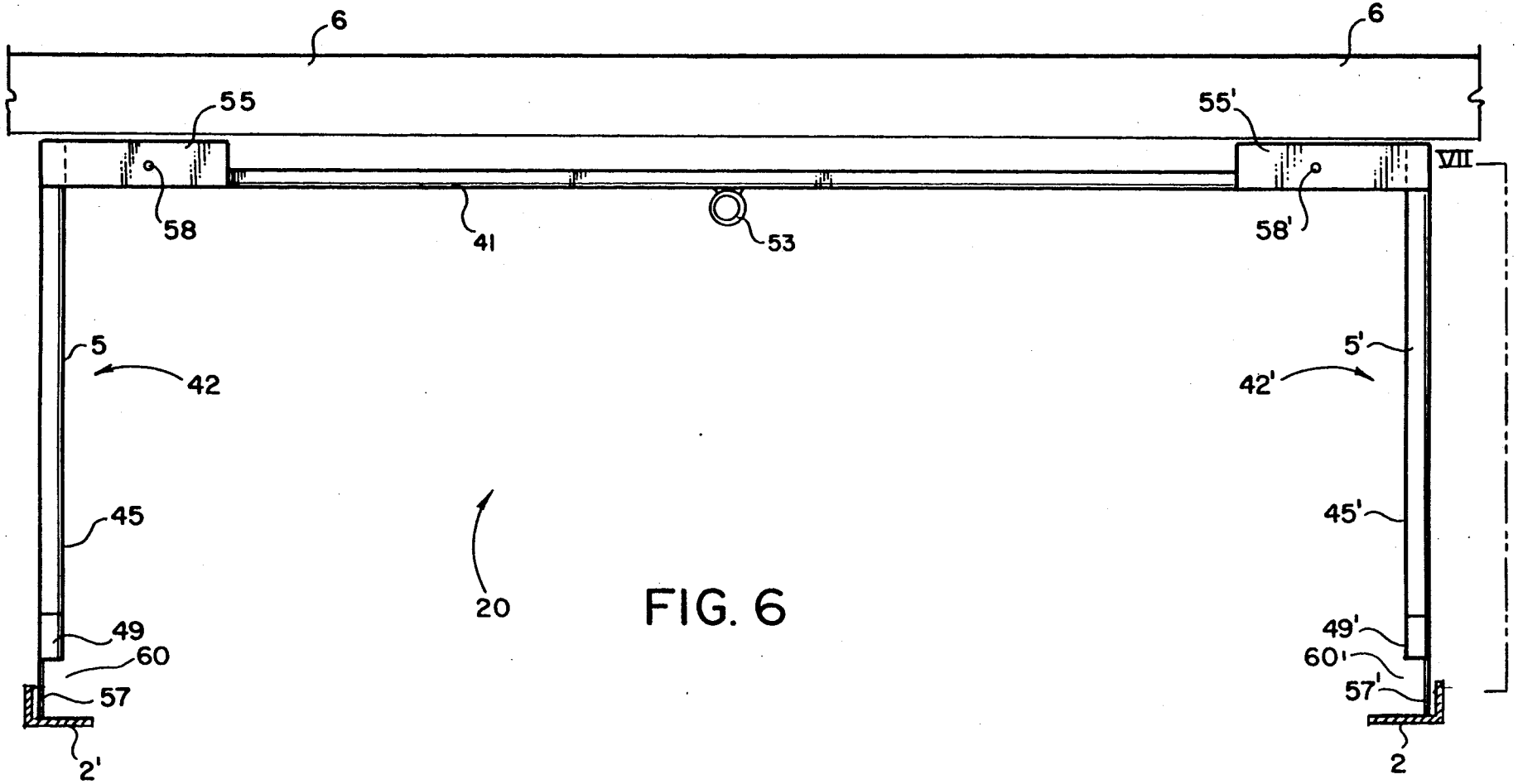
FIG. 6 shows a front view of the hoisting device used in the method of installing the platform assembly.

With reference to FIG. 6, a device for hoisting the platform assembly 10 of the present invention is shown and generally designated by reference numeral 20 and is seen to include cross brace 41 having a lifting ring 53, frames 42 and 42', the frames having members 45, 45', 49, 49', 55, 55' and plates 57 and 57'. Cross brace 41 is supported by frames 42 and 42' by insertion of cross brace 41 into hollow members 55 and 55', secured therein by holding pins 58 and 58'. The entire device is designed to be situated between adjacent girders 5 and 5' and supported on girder flanges 2 and 2' by plates 57 and 57'. Plates 57 and 57' rest on the I-beam flanges 2 and 2', respectively, creating openings 60 and 60', respectively, which permit the roller assemblies to roll along the I-beam flange without obstruction by the hoisting device 20.

Figure 7:
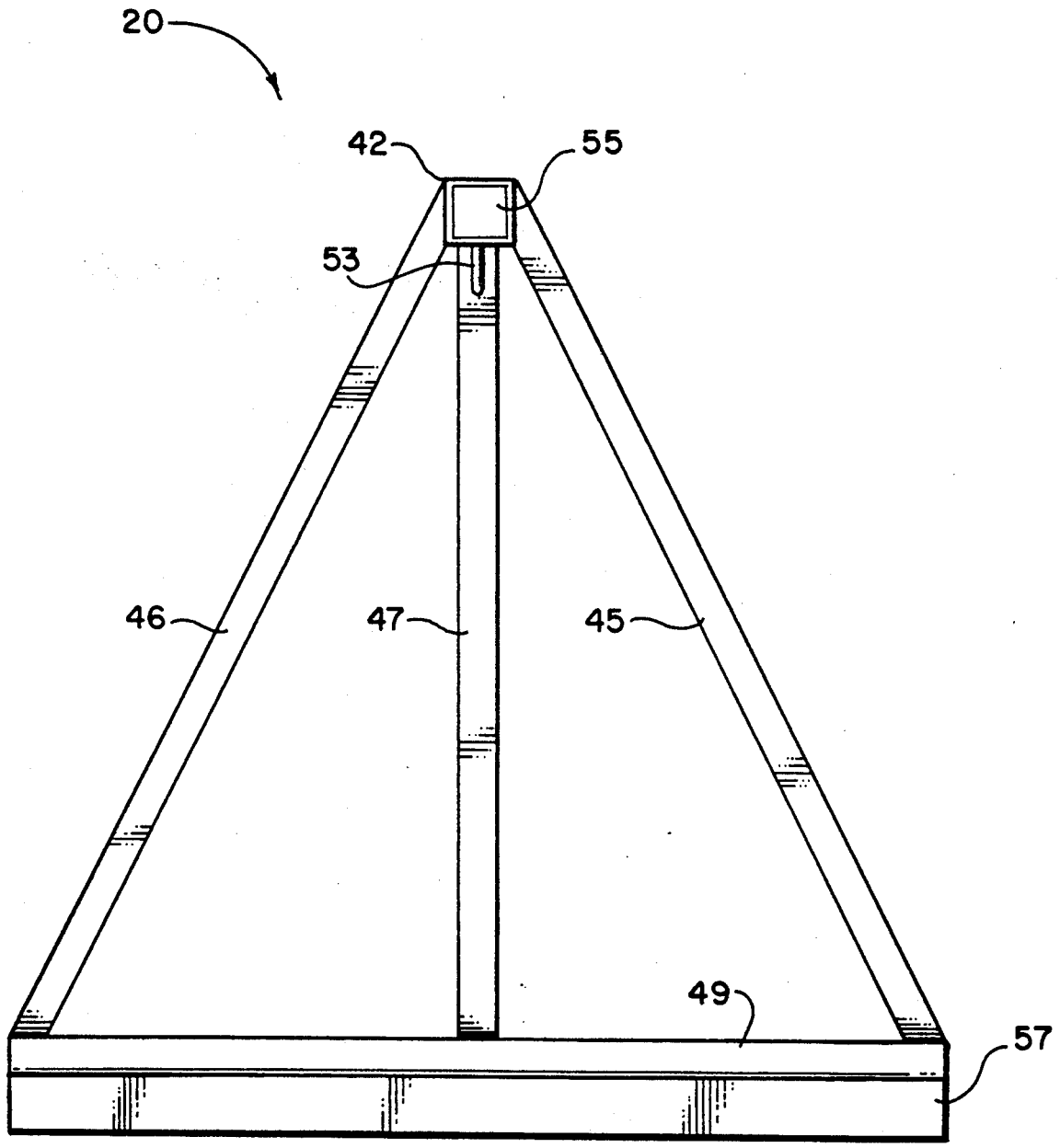
FIG. 7 shows a cross-sectional view along the line VII—VII of FIG. 6.

FIG. 7 illustrates a side view of the hoisting device taken along line VII—VII of FIG. 6 more clearly depicting the frame member 42. As can be seen from the drawing, the frame member 42 is triangular in shape and includes members 45, 46 and 47, each connected to member 49 and 55, respectively. Attached to member 49 is plate 57 which acts to support the hoisting device on girder flange 2.

Figure 8:
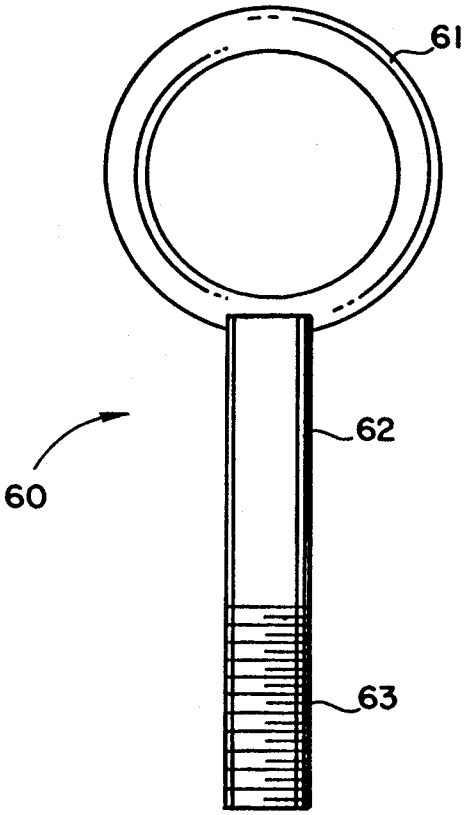
FIG. 8 shows a lifting or tugging ring detached from the platform assembly.

FIG. 8 depicts a ring device 60 detached from the platform assembly 10. The ring device 60 is shown with ring 61, member 62 with threaded portion 63. The ring device 60 may be attached to the center of the platform to act as a lifting ring during hoisting thereof or the ring device 60 may be located centrally at one end of the platform to allow the platform to be slid along the girder flanges during installation thereof. Although the ring device 60 is depicted as having a threaded portion for attaching to the platform assembly 10, other means of attachment may be utilized such as welding or pinning.

Although not depicted in the drawings, adjacent platform assemblies that have been secured to the flange girders by clamping assemblies may be attached to each other by any conventional techniques such as a connecting member and self-tapping screws.

The method of installing the platform assembly of the present invention will now be described.

Firstly, a bridge is provided wherein at least a portion thereof is scheduled to be repaired or demolished. Supporting the bridge are a plurality of flanged girders arranged in spaced relationship to each other. Underneath the bridge may be traffic, vehicular or pedestrian, that may be affected by demolition or repair of a portion of the bridge. The rolling platform assembly is installed underneath the bridge to prevent impediment of this traffic during the demolition or repair process. Additionally, on divided overpasses the platform assembly may be installed using the median strip between the highway such that traffic is not obstructed during installation. Once a bridge is selected to be repaired or demolished the sliding platform assembly is installed by the following steps:

(a) A first platform is hoisted beneath adjacent flanged girders of the bridge wherein the transverse width of the platform approximates the width between adjacent girders of the bridge. This hoisting step may be done using conventional hoisting techniques such as a crane or may be performed using the improved hoisting device described hereinabove. The platform is preferably hoisted using a lifting ring centrally located on the platform. The hoisting step may take place in the median strip of a divided highway so as not to stop the flow of traffic.

(b) Once the platform has been hoisted between the adjacent flanged girders, roller assemblies are attached to the platform and spaced along the edges of the platform such that the rollers of the roller assemblies rest on the girder flanges see FIGS. 2 and 4. After the roller assemblies are attached, the platform assembly is slid or pulled in a direction parallel to the girder such that the rollers of the roller assemblies travel along the girder flanges of the girder until the platform assembly comes to a rest. This rolling step enables the platform assembly to be installed beneath the bridge and above any traffic passing below the bridge without having to stop the traffic. The rolling or pulling step may be performed using any conventional pulling device such as a come-a-long. A tugging ring similar in structure to the ring used for hoisting aforementioned may be located centrally and along one end of the platform assembly to attach the pulling device to the platform assembly. Of course, other known pulling means as well as means located on a platform for facilitating pulling may be utilized in the inventive method or apparatus.

(c) After the platform assembly has come to rest, the roller assemblies are replaced with clamping assemblies and the platform assembly is secured to the girder flange such that an area below the bridge is occupied by the platform assembly to prevent impediment of traffic beneath the bridge during repair or demolition thereof. As shown in FIG. 2, the clamping assemblies are attached such that the girder flange 2 and shim 15 are between the plate 13 and platform 1 by tightening nut and bolt assembly 17 and 19.

(d) The sequence of steps described in (a) through (c) is repeated until the entire bridge has a platform assembly beneath it. Finally, if any irregular area remains beneath the bridge, platform assemblies may be adapted by cutting of the like to fill in these spaces such that all the area beneath the bridge is occupied by the platform assemblies of the present invention.

The platform assemblies may be sized to any dimensions, length width or thickness to accommodate different sized bridges as well as different loads placed on the platform assemblies from bridge demolition. Additionally, the platform assemblies may be made out of any desired materials. Preferred material for the platform 1 may include plywood with the support tubing and roller and clamping assemblies made of metals of sufficient strength to secure the platform assemblies to the girder flanges as well as to support the loads placed thereon from bridge demolition.

The platform assembly of the present invention provides an improvement over the prior art in that it may be installed without obstructing traffic. The platform assembly may be hoisted beneath a bridge in the median strip of a divided highway and slid underneath the bridge but above the moving traffic so that the traffic beneath the bridge does not have to be halted to install any protective structure beneath the bridge.

As such, an invention has been disclosed in terms of a preferred embodiment which fulfills each and every one objects of the present invention as set forth hereinabove and provides a new and improved sliding platform assembly of great utility and novelty.

Of course, various changes, modifications and alterations in the teachings of the present invention may be contemplated by those skilled in the art without departing from the intended spirit and scope thereof. As such it is intended that the present invention only be limited by the terms in the appended claims.

I claim:

1. A platform assembly for placement under a bridge, said bridge having at least two adjacent flanged girders, said platform assembly designed to prevent impediment of traffic below said bridge during installation of said platform assembly and during demolition of said bridge comprising;

(a) a plurality of platforms, each platform having (1) a transverse width approximating the distance between said adjacent flanged girders, (2) opposed longitudinal edges and (3) opposed transverse edges;

(b) first means located on a said platform for attaching a hoisting means thereto;

(c) second means located on a said platform for attaching a pulling means thereto; and (d) a plurality of roller assemblies located at spaced intervals along each of said longitudinal edges of a said platform, said roller assemblies adapted to roll a said platform along said adjacent girders, (e) whereby said plurality of platforms are in close proximity to said flanged girders so as to prevent impediment of traffic below by bridge material falling below due to said demolition.

2. The platform assembly of claim 1, further including a plurality of clamping means, each said clamping means being adapted to replace a said roller assembly such that said plurality of clamping means clamp said platforms to said adjacent girders.

* * * * *